US005556508A

United States Patent [19]

Ekholm et al.

[11] Patent Number: 5,556,508

[45] Date of Patent: Sep. 17, 1996

[54] METHOD FOR TREATING PULP

[75] Inventors: Rolf Ekholm; Ulf Jansson, both of Karlstad, Sweden

[73] Assignee: Kvaerner Pulping Technologies Aktiebolag, Sweden

[21] Appl. No.: 313,135

[22] PCT Filed: Feb. 16, 1993

[86] PCT No.: PCT/SE93/00115

§ 371 Date: Sep. 30, 1994

§ 102(e) Date: Sep. 30, 1994

[87] PCT Pub. No.: WO93/21377

PCT Pub. Date: Oct. 28, 1993

[30] Foreign Application Priority Data

Apr. 8, 1992 [SE] Sweden ..... 9201114

[51] Int. Cl.[6] ..... D21C 9/02; D06B 1/02

[52] U.S. Cl. ..... 162/60; 162/52; 8/156

[58] Field of Search ..... 162/60, 55, 246, 162/52, 58, 232; 210/374, 377, 380.1; 68/152, 148, 158, 181; 8/156

[56] References Cited

U.S. PATENT DOCUMENTS

| | | | |
|---|---|---|---|
| 5,013,460 | 5/1991 | Meredith | 210/770 |
| 5,204,009 | 4/1993 | Rowland | 210/772 |
| 5,221,434 | 6/1993 | Henricson | 162/52 |

FOREIGN PATENT DOCUMENTS

| | | | |
|---|---|---|---|
| 0337432 | 10/1989 | European Pat. Off. | D21D 1/40 |
| 0428004 | 5/1991 | European Pat. Off. | D21C 9/06 |
| 0438092 | 7/1991 | European Pat. Off. | D21D 5/20 |
| 2059469 | 4/1981 | United Kingdom . | |

*Primary Examiner*—Donald E. Czaja
*Assistant Examiner*—Calvin Padgett
*Attorney, Agent, or Firm*—Ronald P. Kananen

[57] ABSTRACT

A method for washing a fibre suspension including the steps of feeding the suspension into an annular displacement space, supplying a fluid through a permeable outer surface of the space, rotating the space to establish a fibre layer between the fluid supplied through the permeable outer surface of the displacement space and a remaining part of the fibre suspension.

9 Claims, 2 Drawing Sheets

METHOD FOR TREATING PULP

The following invention relates to a method and a device for treating fibre suspensions, in particular for washing a fibre suspension in the form of cellulose pulp.

It is well known that fibre suspensions exhibit very special properties which demand special measures in connection with treating such suspensions. Washing a fibre suspension is an example of a treatment of this nature which requires special measures because of the special behaviour of a fibre suspension. More or less complicated apparatus for this purpose is already known. A feature possessed in common by these known processes and devices is, however, that, in connection with the actual liquid penetration phase, there is physical contact between a significant part of the fibre suspension and some form of sieving device. In connection with pulp production, in particular, such physical contact is undesirable since it gives rise to friction between the pulp bed and the sieving device, which in turn can cause disturbances in the feed-through of the pulp bed.

An object of the present invention is to present a method and a device which make it possible to change the liquid content of a fibre suspension in an effective manner without exposing the pulp bed to undesirable physical stresses.

The above mentioned object is achieved with the aid of a method and device according to the present invention, as described below.

From EP 0337 432 there is known a method of treating a fibre suspension to alter its liquid content, whereby the suspension is fed into a displacement space (12) whose outer limiting surface (2B) rotates around the axis of symmetry, which surface (2B) is permeable to fluid and is affected by a fluid under pressure acting from the outside. In this known method for washing a fibre suspension there is physical contact between a significant part of the fibre suspension and the sieving device of the washing apparatus. Further the displacement space is divided into several compartments, which increases the total area of pulpcontacting surfaces of the washing apparatus and which also eliminates the possibility of layering of the suspension as a result of the centripetal acceleration. Accordingly there are essential differences between a method known from EP 0337 432 and our invention which is characterised in that the displacement space is rotationally symmetrical and by a high rotation speed whereby as a result of the centripetal acceleration a rapid layering between the fibre and the liquid is established and that said from the outside acting fluid balances the pressure with which the fibre layer as a result of the centripetal acceleration is acting in the direction of said outer limiting surface (2B).

Figure 1:
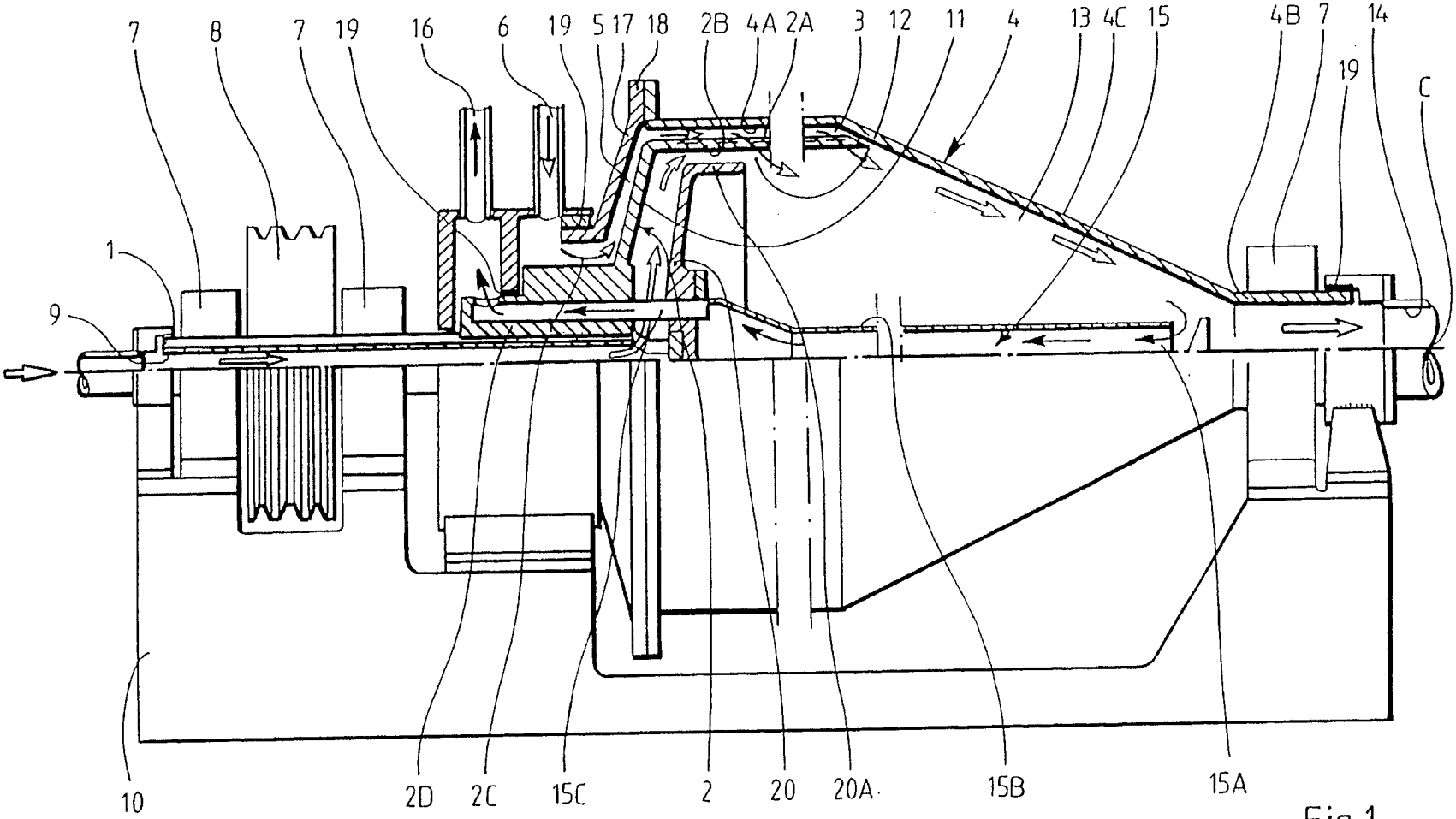
Figure 2:
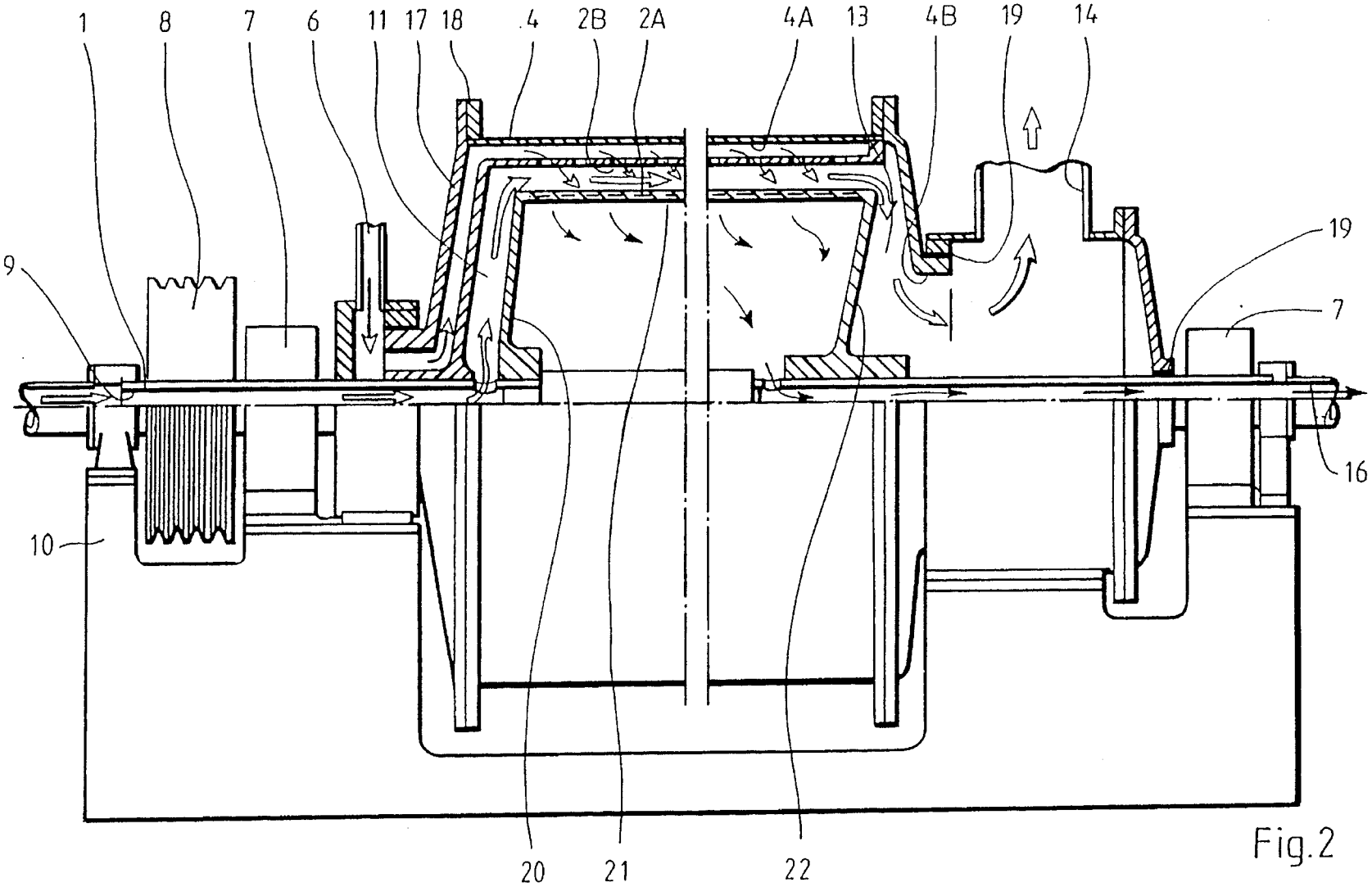

The invention will be explained in more detail below with the aid of the attached drawings, in which:

FIG. 1 shows a preferred embodiment of a device according to the invention, and FIG. 2 shows an alternative embodiment of a device according to the invention.

The device consists of an axle 1 which extends along a line of symmetry C. The axle 1 is arranged to be rotatable in a support 10 with the aid of bearing 7 and to be driven with the aid of a drive 8 in the form of a V-belt system. An arrangement 2, which is Y-shaped in longitudinal section, is connected to the axle 1 so that it turns with it. This Y-shaped arrangement 2 consists of a circular part 2A, 2B, which is liquid-permeable and which extends in an axial direction, a connecting part 2C, which extends essentially radially, and an inner base part 2D which at its inner periphery is connected to the said axle 1, in the preferred case by means of splines. The liquid-permeable part 2A, 2B possesses suitable perforations, for example in the form of circular holes or slits.

A space 3 encloses the circular part 2A, 2B, which space will hereinafter be termed the fluid space 3. The fluid space 3 is delimited outwards by a housing wall 4 which is essentially Y-shaped and which is suspended in bearing 7 by means of its base part 4B. A conical housing part 4C extends between the outermost cylindrical part 4A of the latter housing 4 and the base part 4B. The fluid space 3 communicates via a channel 5 with an inlet arrangement 6 for supplying a fluid, for example washing liquid. The channel 5 is delimited in its essential parts by a cover 17 which is firmly connected to the latter housing 4 by means of a flange 18. Suitable sealing elements 19 are arranged at those places where a rotating part meets a fixed part, such as, for example, at the connecting point between the said cover 17 and inlet arrangement 6.

The inlet arrangement 9 for the pulp suspension is, in this preferred case, a cavity inside the axle 1 which opens out into a channel system 11 which extends essentially radially and which leads to the space 12 in which the change in the liquid content of the pulp suspension is to take place, which space will hereinafter be termed the displacement space 12.

An outlet arrangement 14 for the fibre suspension, arranged centrally inside the axle like the inlet 9, is present at the opposite end of the axle (with respect to inlet arrangement 9). For removing washing liquid etc., a channel system 15 is arranged centrally inside the device with an opening 15A, which is located relatively near to the narrowest part of the cone 4C. The opening 15A is arranged in a long pipe 15B which is fixed in a plate-like arrangement 20. The plate-like arrangement 20 also functions as a cover for the inlet arrangement 9 for the suspension and additionally constitutes one of the limiting surfaces for the channel 11 which leads to the displacement space 12. According to the preferred form, the plate 20 possesses a ring-shaped element 20A at its periphery, which element extends in an axial direction. A smaller pipe 15C leads from the larger pipe 15 to an outlet element 16 for fluid washing liquid or the like.

The device functions in the following manner. Fibre suspension, for example a pulp suspension which has passed through a bleaching step, is fed into the inlet arrangement 9, i.e. into the cavity in axle 1 of the device. The axle, and the parts 2, 4, 15 and 20 connected to the axle, are rotated at a relatively high rotation speed by means of the drive 8. The reason for the high rotation speed is the desire to establish relatively rapid layering between the fibre and liquid in the suspension as a result of the centrifugal force evoked by the rotation. The suspension will flow out of the openings in the axle and enter the channel 11 which leads to the displacement space 12. In this channel the suspension is subjected to a very rapid increase in speed, as a result of the rotation, and at the end of the channel swings in an axial direction and subsequently follows along the inner surface 2B of the liquid-permeable cylindrical part of the Y-shaped device 2, which is rotating in unison. The suspension will thereby be layered so that the heavier fibres come to lie in an outer layer and the lighter liquid in an inner layer. To avoid physical contact at this juncture between the fibre layer and the housing wall 2B, a liquid is supplied to the fluid space 3 at a static pressure which balances the pressure with which the fibre layer is acting in the direction of the inner wall 2B as a result of the centrifugal force. In this way, by supplying liquid via the liquid inlet 6 and forcing in a liquid layer, out from the outer surface 2B and inwards through the cylindrical wall part 2, the ring-shaped suspension cake which has been formed can be lifted up and direct physical contact between the housing and the fibres can be prevented. During this process, liquid will also be forced/ constricted through the fibre bed and washing of the fibre bed will thereby be achieved. Because continuous replenishment of the fibre suspension is taking place, the layer will gradually move to the right in the diagram. Finally, the layer will have moved the whole length of the cylindrical part 2A, 2B and reached the conical part 4C of the device. Just as in a cyclone, both the layers will, due to the rotation and the conicity, move to the right in the diagram down to the narrowest part of the cone. In this region, a separation occurs in that a majority of the liquid is drawn off by turning away into pipe 15, while the fibre suspension will flow out through the centrally arranged outlet arrangement 14 to the right of the diagram.

By regulating the negative pressure inside the liquid outlet channel 15, the liquid content of the outflowing fibre suspension can be regulated to a certain extent, i.e. with a large degree of negative pressure the percentage removal from the suspension is greater than with a low degree of negative pressure. It will be evident to the person skilled in the art that there are also many other factors which can be varied, thereby influencing the result. For example, increased rotational velocity requires increased counter pressure and also provides the possibility of higher through-flow since more rapid layering is achieved at higher rotational velocity etc.

FIG. 2 shows an alternative embodiment of a device according to the invention, in which corresponding arrangements have been given the same reference numbers. The pulp and the washing liquid flow in the same manner in this device as in that described above. By contrast, in the latter alternative, the washing water (the constricted liquid) flows out centrally through its outlet arrangement 16 and the pulp suspension through an outlet arrangement 14 which is not centrally located. Additionally, a long cylindrical part 21 has been built onto the plate arrangement 20 at the inlet channel 11, which cylindrical part, like the enclosing housing part 2A, 2B, is liquid-permeable. Through this cylindrical housing part 21, excess washing liquid is allowed to penetrate in towards the centre of the device. The housing wall is suspended at its other end on a further plate arrangement 22 which also forms a delimiting surface for the channel 13 which conducts the suspension out towards the outlet arrangement 14. The basic principle by which the two embodiments function is essentially the same.

It will be evident to the person skilled in the art that the invention is not limited by that which has been demonstrated above but can be varied within the scope of the subsequent patent claims. Thus, it is, for example, also possible in an embodiment according to the second alternative to allow at least some of the liquid-permeable housing parts 2 and 21 to be conical to some degree. Other changes are to allow only certain parts of, for example, the outer liquid-permeable housing 2A, 2B to be liquid-permeable, for example to guarantee a definite layering before the pulp bed is subjected to counter pressure. Additionally it is possible to alter the fluid space in different ways so that different zones can thereby be obtained, which zones can be operated at different pressures. Beyond this, it is evident that the invention is not limited to applications using water, but that other fluids can be used, i.e. preferably also other types of liquid, but including gases as well. Furthermore, it is conceivable that these fluids can be used for a multiplicity of possible treatment purposes, such as bleaching etc.

We claim:

1. Method for washing a fibre suspension, comprising the steps of:

feeding the fibre suspension into an undivided annular displacement space that rotates around an axis of symmetry, the displacement space having an outer limiting, permeable surface;

supplying, with pressure external to the displacement space, a fluid through the permeable outer surface of the displacement space;

rotating the displacement space with a rotational speed sufficient to establish, by centripetal acceleration of the fibre suspension, a fibre layer between the fluid supplied through the permeable outer surface of the displacement space and a remaining part of the fibre suspension, the fibre layer providing a pressure against the outer limiting surface of the displacement space which at least essentially balances a pressure from the fluid; and moving the fibre suspension and the fluid through the displacement space and discharging the fibre suspension and the fluid from the displacement space.

2. Method according to claim 1, further comprising the step of providing the displacement space with a shape wherein the fibre layer forms an unbroken ring-shaped fibre layer enclosing an inner liquid during said rotating step.

3. Method according to claim 1, wherein the pressure from the fluid is equal to or exceeds the pressure with which the fibre suspension acts against the outer limiting surface so as to prevent direct contact between the fibre layer and the limiting surface.

4. Method according to claim 1, wherein the fluid is forced through the fibre layer due to the pressure on the fluid.

5. Method according to any of the preceding claims, wherein the fluid forms a layer between the fibre layer and the limiting surface, and the fibre layer and the liquid layer are moved through the displacement space in a direction corresponding to the axis of symmetry.

6. Method according to claim 5, wherein the liquid layer is withdrawn from the displacement space by an outlet member arranged in a radial direction relative to the axis of symmetry of the displacement space.

7. Method according to claim 1, wherein the displacement space is at least partially delimited by an inner limiting surface.

8. Method according to claim 7, wherein the inner surface is liquid permeable.

9. Method according to any one of claims 1 to 4, wherein the fibre suspension is fed into the displacement space via at least one channel that is, at least in part, located at a shorter radial distance from the axis of symmetry than a radial width of the displacement space.

* * * * *